United States Patent [19]

Bowman et al.

[11] 4,118,284

[45] Oct. 3, 1978

[54] PLUG-TYPE COKE OVEN DOOR

[75] Inventors: Walter A. Bowman, Pleasant Hills Borough; Richard L. Wessel, Plum Borough, both of Pa.

[73] Assignee: United States Steel Corporation, Pittsburgh, Pa.

[21] Appl. No.: 847,198

[22] Filed: Oct. 31, 1977

[51] Int. Cl.[2] ..... C10B 25/06

[52] U.S. Cl. ..... 202/248; 110/173 R

[58] Field of Search ..... 202/242, 247, 248; 110/173 R

[56] References Cited

U.S. PATENT DOCUMENTS

| | | | |
|---|---|---|---|
| 2,855,347 | 10/1958 | Cellan-Jones | 202/248 |
| 2,993,845 | 7/1961 | Coe | 202/248 |

FOREIGN PATENT DOCUMENTS

| | | | |
|---|---|---|---|
| 1,102,059 | 4/1956 | France | 202/248 |
| 2,317,581 | 10/1974 | Fed. Rep. of Germany | 202/248 |
| 475 of | 1906 | United Kingdom | 202/248 |
| 598,975 | 3/1948 | United Kingdom | 202/248 |

*Primary Examiner*—Morris O. Wolk
*Assistant Examiner*—Roger F. Phillips
*Attorney, Agent, or Firm*—Arthur J. Greif

[57] ABSTRACT

In the construction of a plug-type, coke oven door, which plug is fitted with an integral flue or duct for venting of gases, the front and side walls of the plug are constructed so as to provide sufficient thermal conductivity, whereby heat entering the duct, primarily by conduction through the front wall, may readily be transferred to the left and right side walls thereof so as to maintain a desirable high temperature boh within the duct and at the exterior surfaces of the side walls to prevent or significantly decrease carbon accumulation.

4 Claims, 3 Drawing Figures

PLUG-TYPE COKE OVEN DOOR

This invention relates to an improvement of the conventional flue-vented, plug-type, coke oven door. Coke oven doors are a source of particulate and gaseous emissions, particularly during the early stages of the coking cycles. In the past, such emissions have been decreased through the use of pressure-relief design concepts in which an integral flue venting system is incorporated within the refractory plug as a vertically extended duct for carrying gases to the top-most portion of the plug above the level of the coal line. In comparison with the use of ductless plug-type, coke oven doors, such integral venting systems, e.g. as shown in U.S. Pat. No. 2,855,347, have been found to be effective in significantly lowering gas channel pressures. For example, pressures in the lower part of the gas channels of plug-type doors having an integral flue venting system decreased to 1 mm of water during the first 20 minutes of the coking cycle; as compared with pressures greater than 100 mm measured for the first 30 to 90 minutes of the coking cycle, in plug-type doors having no such vent system. Nevertheless, we have found that the use of such conventional small diameter (4 inch) verticale flues led to problems of carbon build-up, both at the inner surfaces of the flue and the outer surfaces of the plug and, at least in some cases, an equally serious problem of plugging of the flue with coal and coke. We have further found, that these problems could be overcome by modifying the design of the plug, in order that the surfaces susceptible to such carbon build-up would operate, during coking, at significantly higher temperatures, thereby creating a self-cleaning effect.

Figure 1:
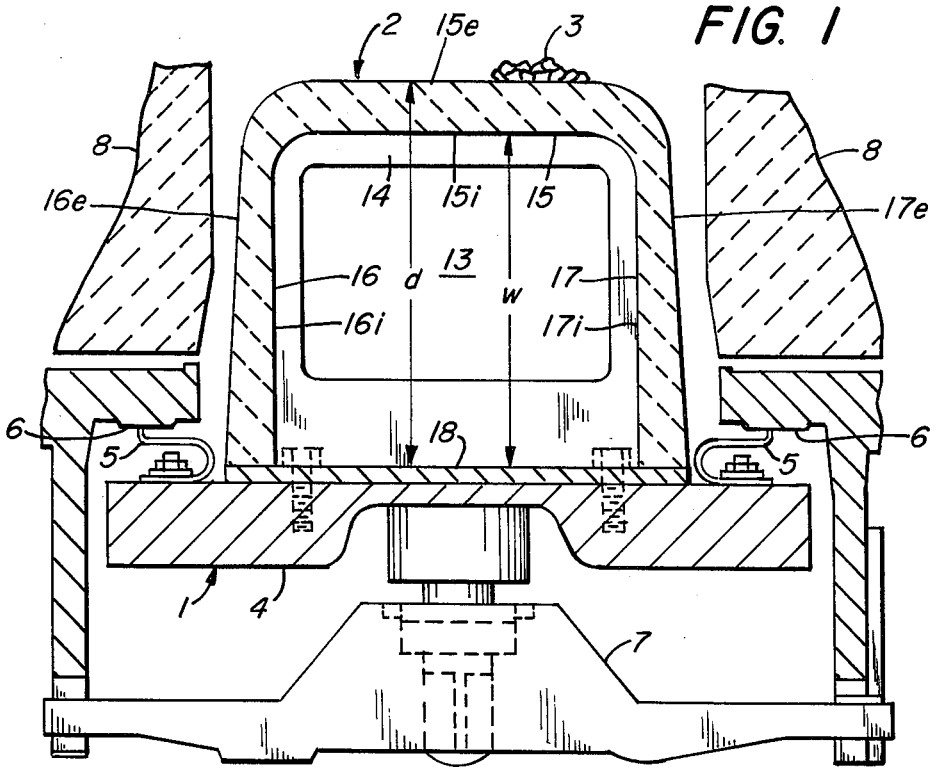
Figure 3:
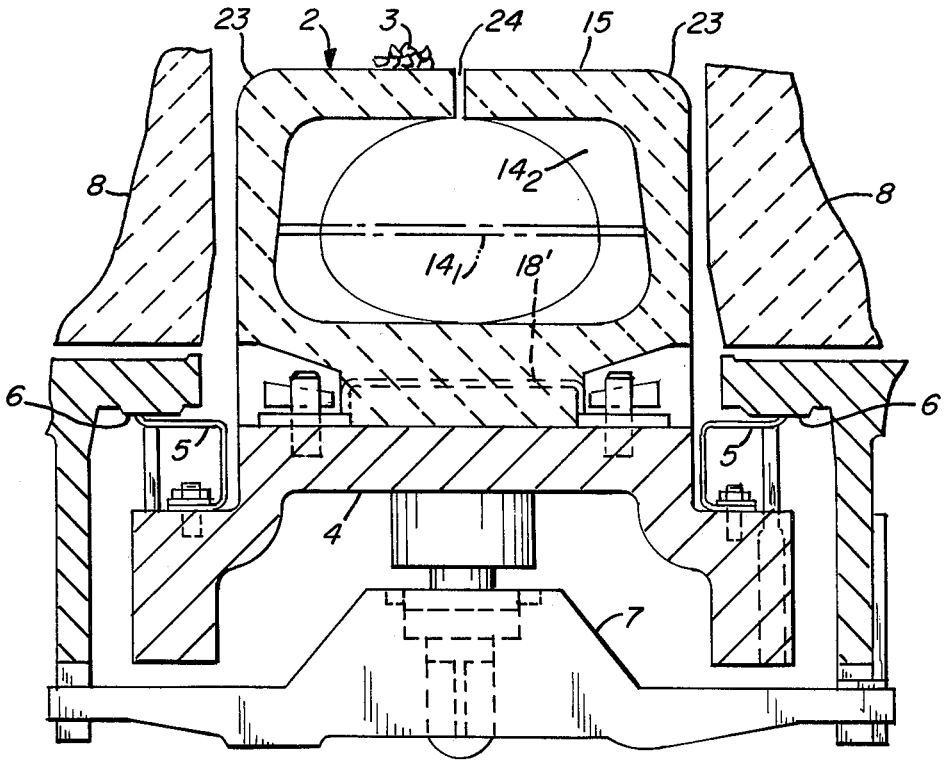
Figure 2:
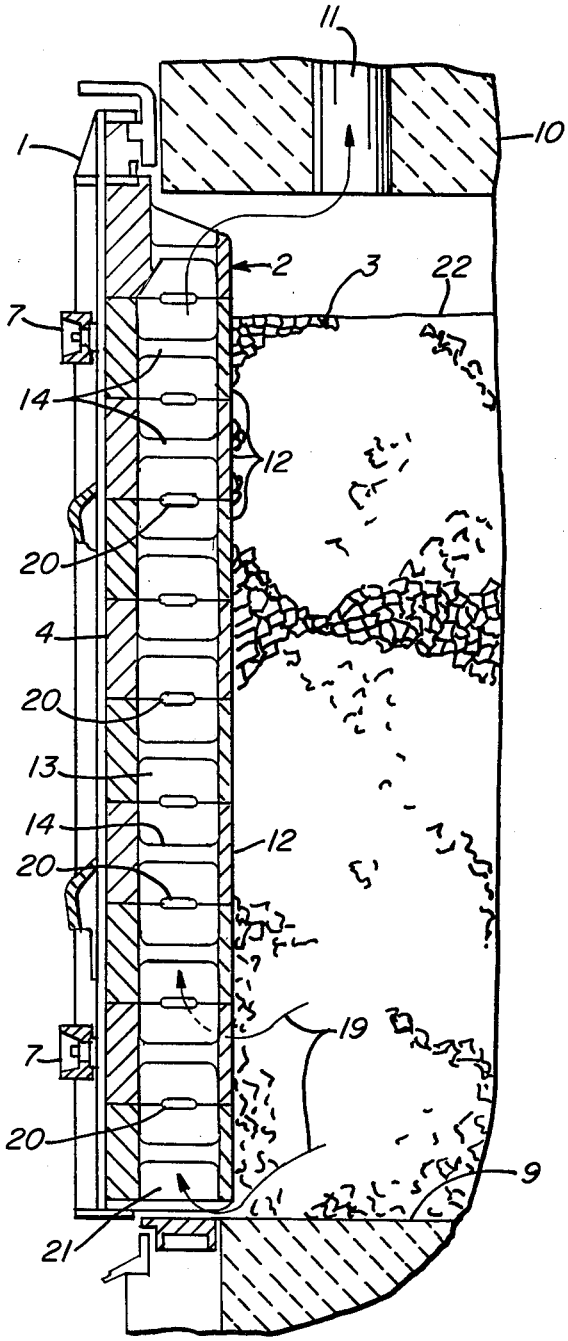

The above as well as other advantages of the instant invention will become more apparent from the following description, when read in conjunction with the appended claims and the drawings in which:

FIG. 1 is a horizontal cross-section, illustrating certain requisite features of the instant pressure-relief door and FIG. 2 is a vertical section of a portion of a coke-oven, showing the instant pressure-relief plug-type, coke oven door, and the route of gas pressure relief and FIG. 3 is a horizontal cross-section of a variant design, showing certain preferred embodiments of the invention.

As shown in FIGS. 1 through 3, plug-type, coke-oven doors consist of two basic elements, a cast metal outer door 1 and an inner-plug section 2, which usually is made of a refractory material, but as shown in U.S. Pat. No. 2,993,845 may also be constructed from metal. The prime purpose of the plug element is to provide a medium which (i) provides insulation to protect the cast metal outer door, (ii) decreases the heat loss from the coal 3 abutting the plug. The outer door may have a frame 4 which carries sealing members 5 engaging the jam 6. The frame is held in closed position to the oven with conventional latching means 7. When in the closed position, as illustrated, the inner plug element is bounded on the sides by the refractory coke oven walls 8, on the bottom by the oven floor 9 and at the top by the oven roof 10 fitted with accession pipe 11. The plug may utilize a conventional monolithic construction, as shown in the '347 patent; or as a preferred embodiment (shown in FIG. 2) the plug element may be composed of a plurality of discrete sections 12 vertically aligned and abutting end to end. Each of the sections (FIG. 2) has a flue opening 13 aligned so as to form a continuous flue or duct extending the full height of the plug element. To provide enhanced physical strength, each section may be provided with a reinforcing rib 14. As better illustrated in FIG. 1, the plug is composed basically of front wall 15 and left and right side walls, 16 and 17 respectively. Side walls 16 and 17 may be directly connected to frame 4, eg. via steel plate 18 or the plug may be provided with a rear wall and connected to the frame by a variety of well known anchoring means, eg. 18' (FIG. 3). As shown in FIG. 2, venting of gases is achieved in a manner analogous to that of the conventional, small-diameter flues. Gases 19 resulting from the coking operation enter the flue, both through inlet openings 20 and the bottom 21 of the plug, are carried to the top of the plug above the coal line 22 and are removed via accession pipe 11 to the collector main (not shown).

The instant invention departs from the conventional ducted-type refractory plug, by utilization of (i) significantly thinner front and side walls—walls capable of conducting heat much more readily than those in the conventional design and (ii) a significantly larger (in cross-section) flue, the reasons for which, appear below. Since the sections of the coke oven walls facing the exterior surfaces of side walls 16 and 17 are unheated, the principle source of heat entering flue 13 is the thermal flux flowing from the hot coals 3. Operating skin temperatures at two different periods (period 1 . . . 30 minutes before the end of coking cycle and period 2 . . . 10 minutes before the coal charge) were measured for different plug designs. For the plug design of the instant invention, i.e. FIG. 1, the temperatures of the exterior face $\mathbf{15}_e$ were 1395° F. and 1580° F. for periods 1 and 2 respectively. By contrast, the temperatures of the gases passing through flue 13 will have an average temperature of 600° to 700° F. and may be as low as 250° F. These escaping gases act to counter the thermal flux from the hot coal and coke, thereby tending to cool the interior surfaces of the flue. By providing for significantly greater conductivity through the cross-section of walls 15, 16 and 17, the heat flux from the hot coals enters the flue; heating interior face $\mathbf{15}_i$ principally by conduction and faces $\mathbf{16}_i$ and $\mathbf{17}_i$ principally by radiation. Both the hotter skin temperatures of the interior faces, and the use of thinner side walls, offers enhanced conduction of heat to exterior faces $\mathbf{16}_e$ and $\mathbf{17}_e$. Thus, for the plug depicted in FIG. 1, temperatures in excess of 1100° F. were measured, at both the interior and exterior faces ($\mathbf{16}_i$ and $\mathbf{16}_e$) of the side wall. These temperatures are generally about 300° F. higher than those achieved utilizing a solid-type plug or one with the conventional small diameter flue, i.e. one having an average mean-path of about 6 inches (the path from the center of the front face to the corners thereof varies from about 4 to 8 inches) for the thermal flux entering the front face. Carbon buildup is thought to result, directly from the volatilization of coal in contact with the plug surfaces and from condensation of tars in the gases passing through the plug. Apparently, the self-cleaning exhibited by the instant plug, is achieved by maintaining a temperature within the flue and at the side walls, high enough to remove most or all of this volatile matter and prevent such condensation.

It may be readily be seen that the instant invention has two basic requisites: (i) the use of comparatively thin plug walls, having a cross-sectional thickness (except for reinforcing ribs) of less than three inches and a thermal conductivity of at least 0.3 Btu/(hour) (sq.ft.)

(°F/ft.). Desirably, greater than 90% of the combined length of the front, and left and right side walls will meet this thickness requirement; and (ii) The lack of obstructions within the flue itself, whereby heat entering through the front wall may readily be radiated to the interior faces of the side walls. For example, while vertically aligned reinforcing ribs $\mathbf{14}_1$ (as shown in FIG. 3) may be employed, the use of same is considered less desirable than horizontal ribs $\mathbf{14}_2$, since such vertical ribs shield portions of the interior surfaces from each other decreasing the amount of heat being radiated to all the interior surfaces of the plug, with the concomitant decrease in temperature not only of such interior surfaces, but of the exterior surfaces of the side walls, as well. These two requisites, in combination, lead to the use of a flue having a significantly greater cross-sectional area than the conventional flue, thereby providing the further advantage of decreasing the tendency of the flue to become plugged with coal and coke. When such plugging does occur, the flue can no longer adequately vent the gases, causing a build-up of pressure at the door seals and the concomitant emission of pollutants. Therefore, for the plug to achieve its primary insulating function and to insure against such undesirable plugging of the flue, it is desirable that the side walls have a width *w* of at least about 8 inches. To achieve a substantial elimination of undesirable carbon accumulation on the exterior surfaces of the side walls, it is also desirable that such width be a major portion of the total plug depth *d*, and preferably be at least 75% of *d*.

It was found, even when utilizing the heretofore disclosed design concepts, that plug life for certain refractories was very short. Initially, an average service life of only about three months was achieved. This short service life, resulted from the occurrence of vertical cracks along the corner sections 23, referring to FIG. 3. Initially, it was thought that such cracks resulted from mechanical abuse, i.e. flexing of the door during handling. As a result of a computer study, however, it was discovered that such cracks resulted primarily from thermal stress in the walls. It was determined that the failure of the trial door plugs was directly related to the plug cross-sectional design and the characteristic thermal expansion of the material from which the plugs were fabricated. On the basis of such calculations, it was determined that a preferred geometric configuration would be one in which the front wall 15 is provided with an expansion gap 24 (desirably having a width of about $\frac{1}{4}$ to $\frac{3}{4}$ inches) extending substantially the full length of the plug. In some cases, however, such a gap may weaken the plug's ability to withstand the lateral pressures of the coke and the mechanical abuse of door handling equipment. Alternatively, the plug may be fabricated from a material with an inherent low coefficient of thermal expansion. If refractories are employed, pre-fired, fused silica or cordierite would be preferred materials of construction. Clearly, resistance to thermal stresses could also be achieved by a substitution, for the conventional refractory, of a metallic construction material, e.g. as shown in U.S. Pat. No. 2,993,845. When metal is used as the primary construction material, it is desirable to utilize a metal capable of providing both sufficient structural integrity and resistance to the environment encountered during the coking operations—an environment consisting of very high temperatures, in combination with a corrosive atmosphere containing significant concentrations of carbon and sulfur. In this regard, the stainless steels, and the ferritic stainless steels in particular, are known (see *Making, Shaping and Treating,* 9th Edition, pages 1179 and 1180) to be particularly suitable for such environments.

We claim:

1. In a plug-type coke oven door which includes an outer door element and an inner plug element, said plug having (i) a front wall and (ii) left and (iii) right side walls connected to said outer door element, the interior region defined by the three walls having a duct therein permitting the passage of gases to the top portion of the plug, the improvement for significantly decreasing carbon accumulation within said duct and on the exterior surfaces of the left and right side walls, in which (a) essentially the entire cross-sectional thickness of said three walls is less than three inches, and are sufficiently thin to provide a thermal conductivity of at least 0.3 Btu/(hour) (sq.ft.) (°F/ft.) and (b) the left and right side walls have a width of at least 8 inches, said width being more than one half the depth of the plug, the interior of said duct being substantially unobstructed, in order that heat entering therein, primarily through the exterior face of said front wall, may readily be transferred to the interior faces of said left and right side walls and, in turn, to the outer faces thereof.

2. The plug-type door of claim 1, in which said three walls are constructed primarily of a high temperature refractory material.

3. The plug-type door of claim 2, in which said front wall has an expansion gap running substantially the entire length thereof, said gap having a width of about $\frac{1}{4}$ to $\frac{3}{4}$ inches.

4. The plug-type door of claim 1, in which said three walls are constructed primarily of a metal capable of providing sufficient structural integrity and resistance to the environments encountered during coking operations.

* * * * *